US010604306B2

(12) United States Patent
Sung

(10) Patent No.: US 10,604,306 B2
(45) Date of Patent: Mar. 31, 2020

(54) ASSEMBLED CONTAINER CAP

(71) Applicants: Dae Suck Kang, Seoul (KR); Jung Koo Kang, Seoul (KR)

(72) Inventor: Bo Youn Sung, Seoul (KR)

(73) Assignees: Dae Suck Kang, Seoul (KR); Jung Koo Kang, Seoul (KR)

( * ) Notice: Subject to any disclaimer, the term of this patent is extended or adjusted under 35 U.S.C. 154(b) by 0 days.

(21) Appl. No.: 15/515,147

(22) PCT Filed: Nov. 24, 2016

(86) PCT No.: PCT/KR2016/013605
§ 371 (c)(1),
(2) Date: Mar. 28, 2017

(87) PCT Pub. No.: WO2017/095073
PCT Pub. Date: Jun. 8, 2017

(65) Prior Publication Data

US 2018/0229899 A1 Aug. 16, 2018

(30) Foreign Application Priority Data

Nov. 30, 2015 (KR) ..... 10-2015-0169483
Mar. 18, 2016 (KR) ..... 10-2016-0032869

(51) Int. Cl.
*B65D 41/04* (2006.01)
*B65D 41/62* (2006.01)
(Continued)

(52) U.S. Cl.
CPC ..... *B65D 41/0478* (2013.01); *B65D 41/0421* (2013.01); *B65D 41/0435* (2013.01);
(Continued)

(58) Field of Classification Search
CPC ..... B65D 41/0478; B65D 41/0471; B65D 41/04; B65D 41/0421; B65D 41/0414;
(Continued)

(56) References Cited

U.S. PATENT DOCUMENTS 2,723,040 A * 11/1955 Merolle ..... B65D 41/28 215/334
2009/0008400 A1 1/2009 Back
(Continued)

FOREIGN PATENT DOCUMENTS

GB 159327 A * 2/1921 ..... B65D 41/0442
JP 58-192249 U 12/1983
(Continued)

OTHER PUBLICATIONS

International Search Report dated Mar. 22, 2017 as received in Application No. PCT/KR2016/013605 (English Translation).
Written Opinion of the International Searching Authority dated Mar. 22, 2017 as received in Application No. PCT/KR2016/013605.

*Primary Examiner* — Robert J Hicks
(74) *Attorney, Agent, or Firm* — Maschoff Brennan

(57) ABSTRACT

A container cap assembly includes an inner cap coupled to an inner surface and an upper end of a container neck and an outer cap maintaining the coupled state of the inner cap, thereby keeping the inside of a container sealed. The container cap assembly includes an inner cap including an outer wall portion corresponding to an inner surface of a neck of a container and a flange portion extending outward from an upper end of the outer wall portion to correspond to an upper end of the neck. An outer cap has a ceiling covering an upper portion of the inner cap and a side wall portion covering an outer circumferential surface of the neck, the ceiling and the side wall portion being integrally formed. The inner circum-
(Continued)

ferential surface of the side wall portion has female threads corresponding to male threads on the outer circumferential surface of the neck.

10 Claims, 11 Drawing Sheets

(51) Int. Cl.
*B65D 41/28* (2006.01)
*B65D 51/20* (2006.01)

(52) U.S. Cl.
CPC ..... *B65D 41/28* (2013.01); *B65D 41/62* (2013.01); *B65D 51/20* (2013.01)

(58) Field of Classification Search
CPC .... B65D 41/0407; B65D 41/62; B65D 41/28; B65D 41/14; B65D 51/20; B65D 51/18; B65D 51/243
USPC ..... 215/330, 329, 316, 228, 364, 356, 355, 215/44, 43; 220/230, 254.8, 254.7, 259.4, 220/259.3, 256.1, 255, 801, 802, 796, 220/304, 288, 212; 81/3.57
See application file for complete search history.

(56) References Cited

U.S. PATENT DOCUMENTS

| | | | | |
|---|---|---|---|---|
| 2009/0314778 | A1 | 12/2009 | Back | |
| 2012/0000880 | A1 | 1/2012 | Im | |
| 2013/0240533 | A1 | 9/2013 | Cho | |
| 2014/0001182 | A1* | 1/2014 | Wood ..... | B65D 41/04 220/254.1 |

FOREIGN PATENT DOCUMENTS

| | | | |
|---|---|---|---|
| JP | 61-141246 | U | 9/1986 |
| JP | 62-115372 | U | 7/1987 |
| JP | 08-295355 | A | 11/1996 |
| JP | H10-129698 | A | 5/1998 |
| JP | 2002-337897 | A | 11/2002 |
| JP | 2006-151405 | A | 6/2006 |
| JP | 2007-001619 | A | 1/2007 |
| JP | 2009-542531 | A | 12/2009 |
| KR | 10-0567206 | B1 | 3/2006 |
| KR | 10-2006-0083446 | A | 7/2006 |
| KR | 10-0671720 | B1 | 1/2007 |
| KR | 10-2010-0101025 | A | 9/2010 |
| KR | 10-2012-0072582 | A | 7/2012 |
| WO | 2007/043807 | A1 | 4/2007 |
| WO | 2008/002093 | A1 | 1/2008 |

* cited by examiner

【FIG. 1a】
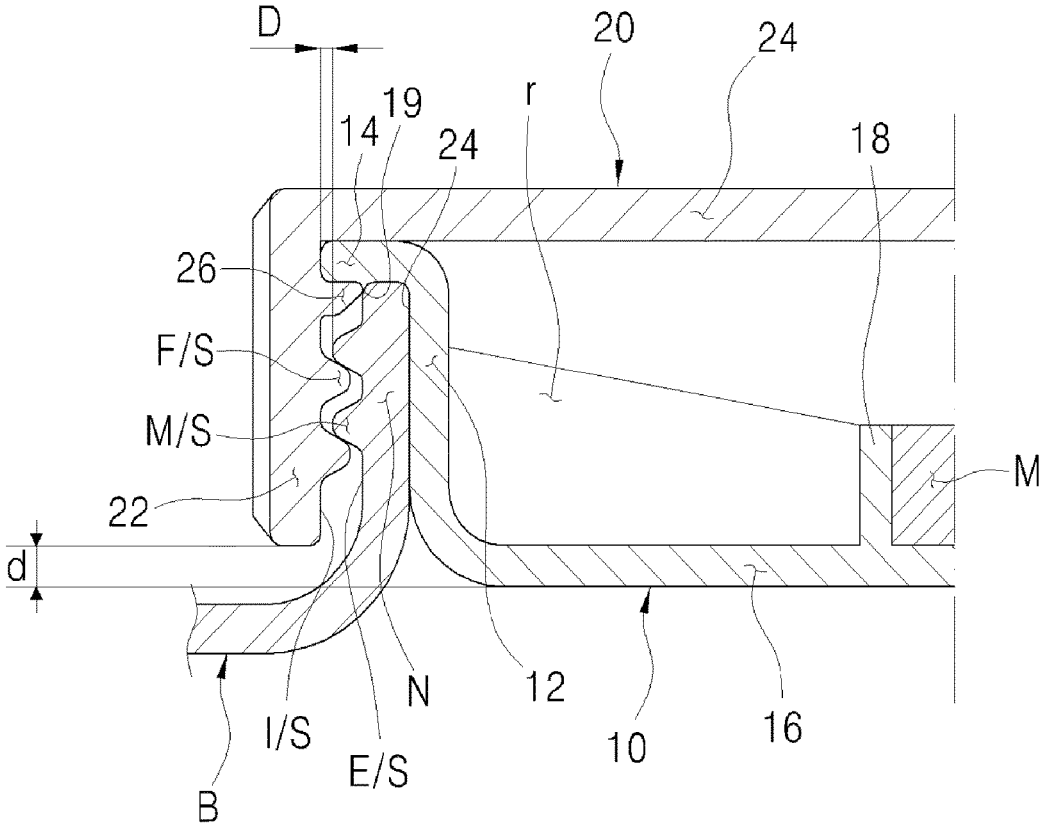

【FIG. 1b】
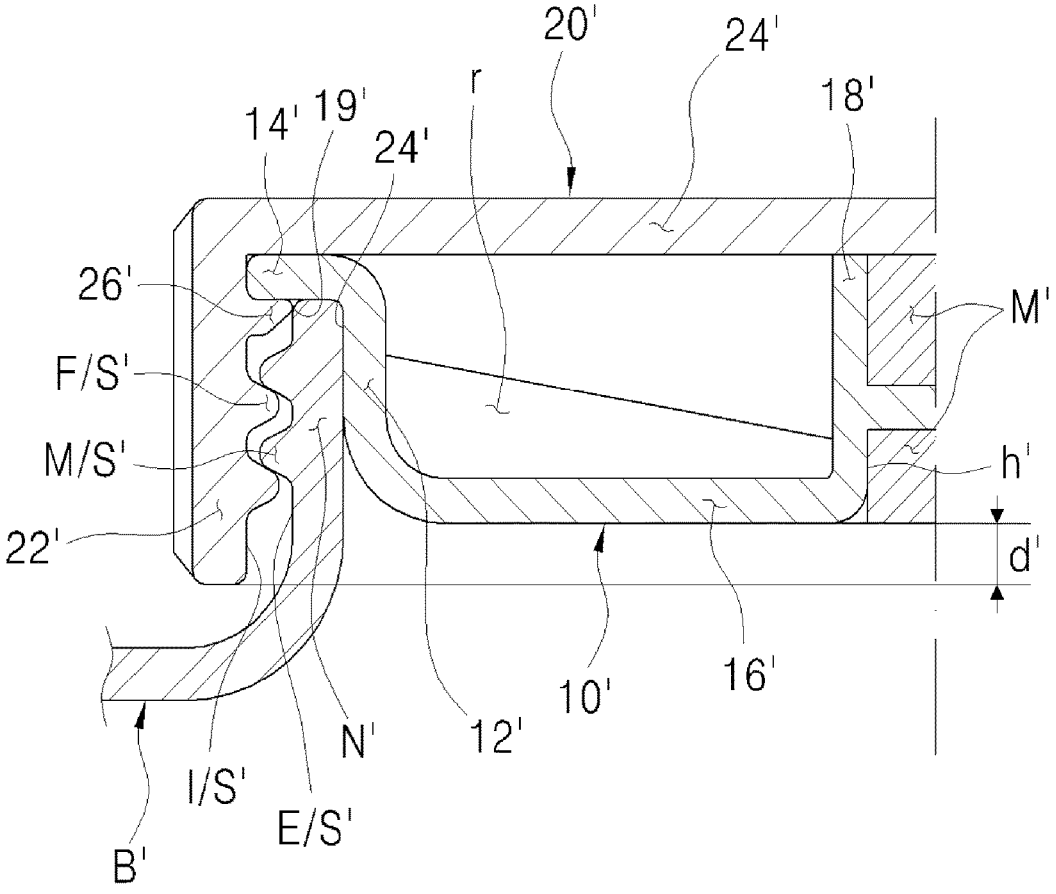

【FIG. 2】
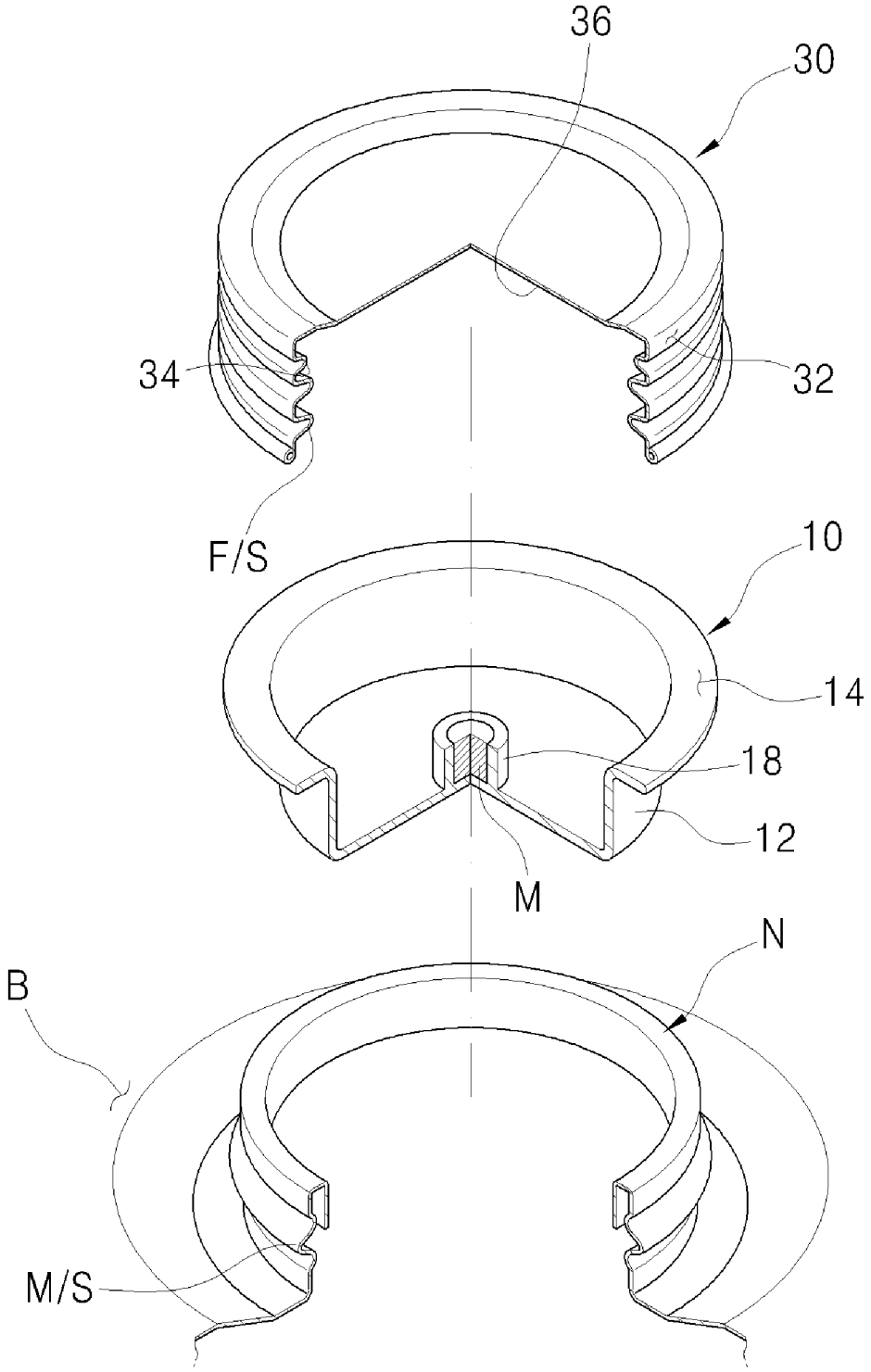

【FIG. 3】
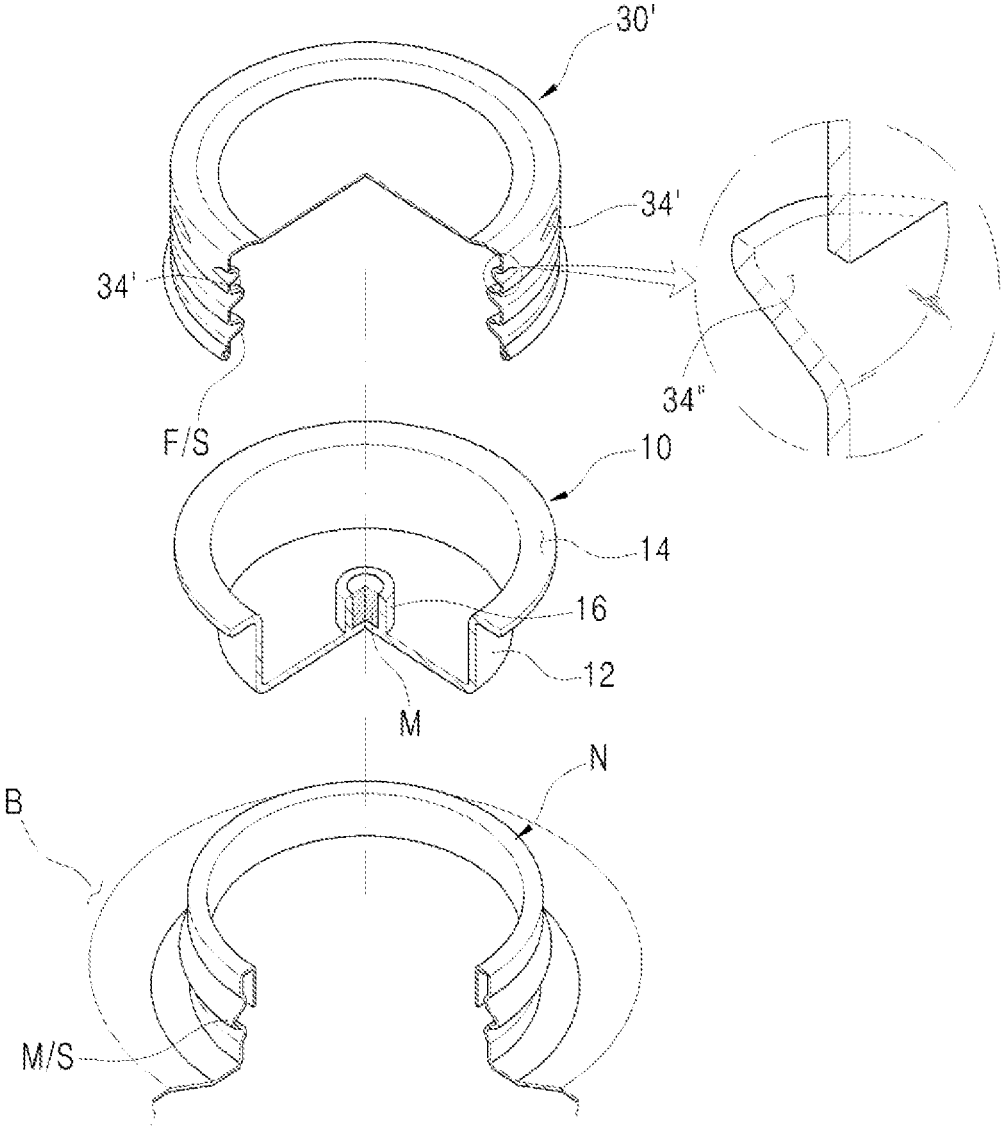

【FIG. 4a】
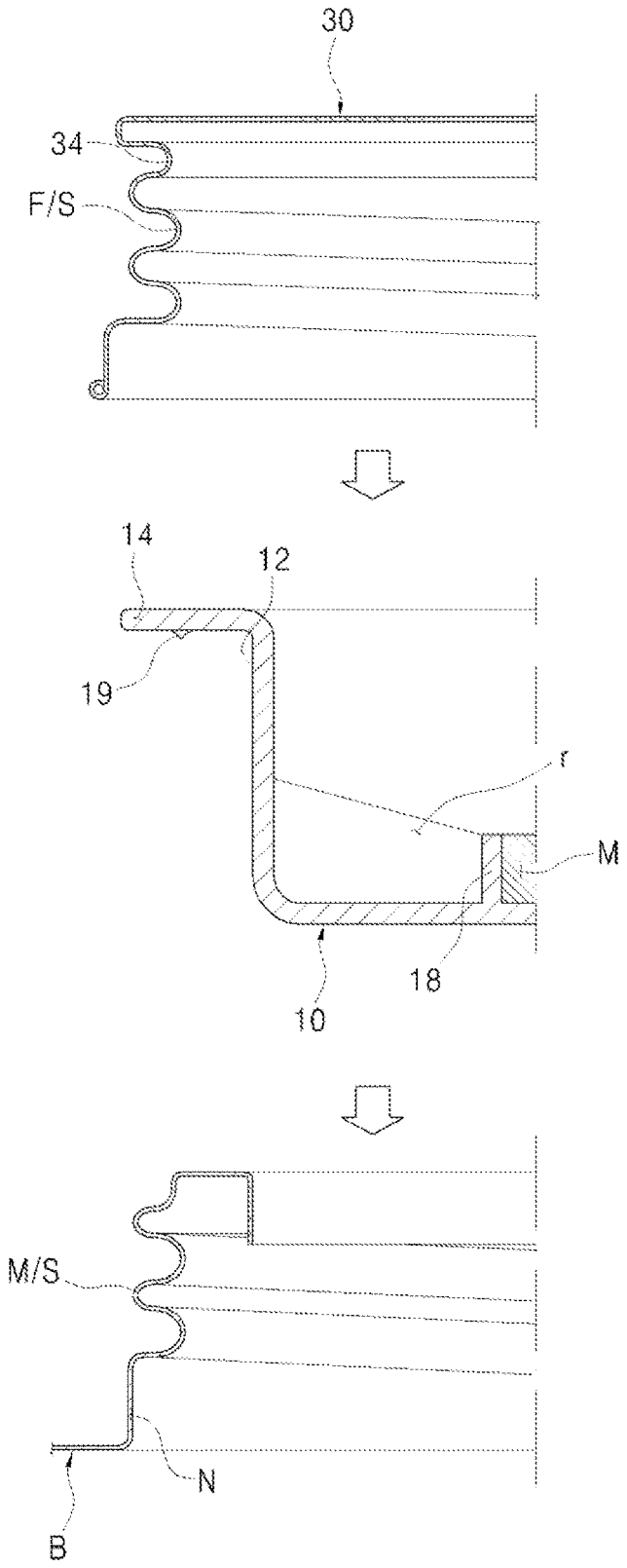

【FIG. 4b】
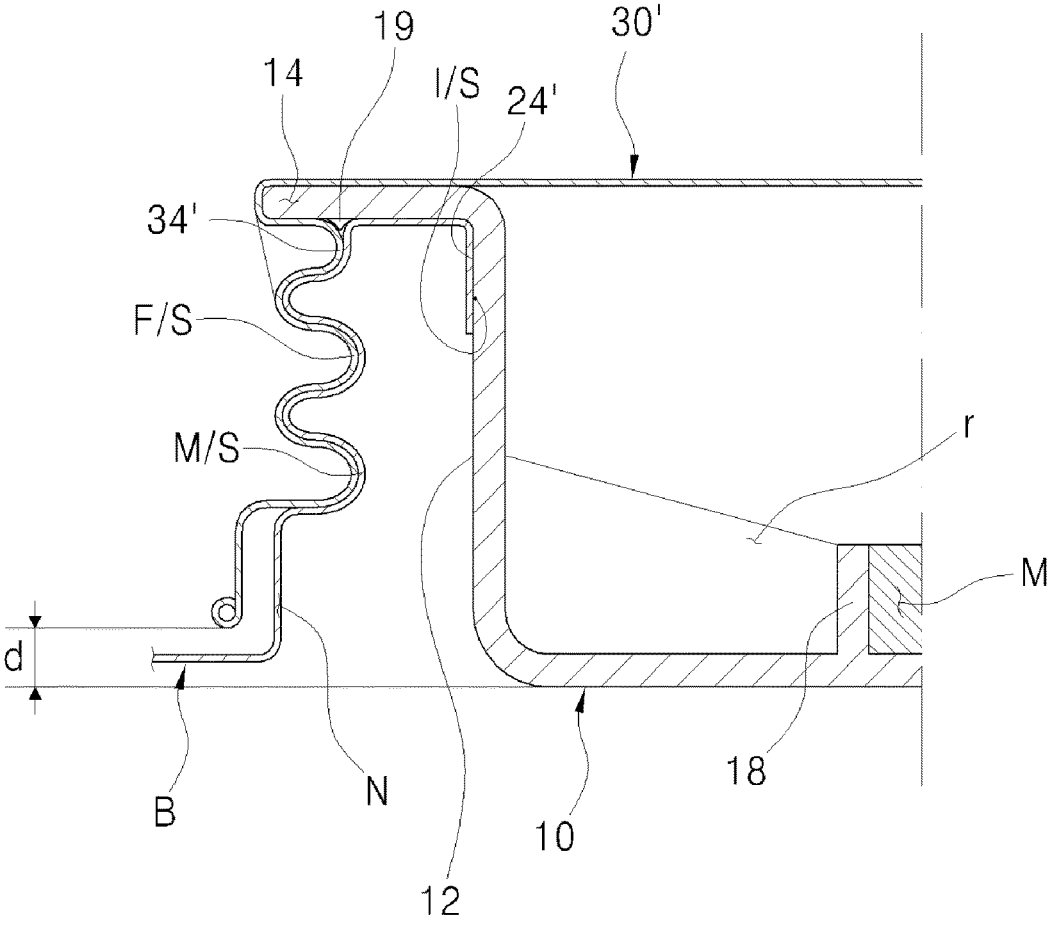

【FIG. 5】
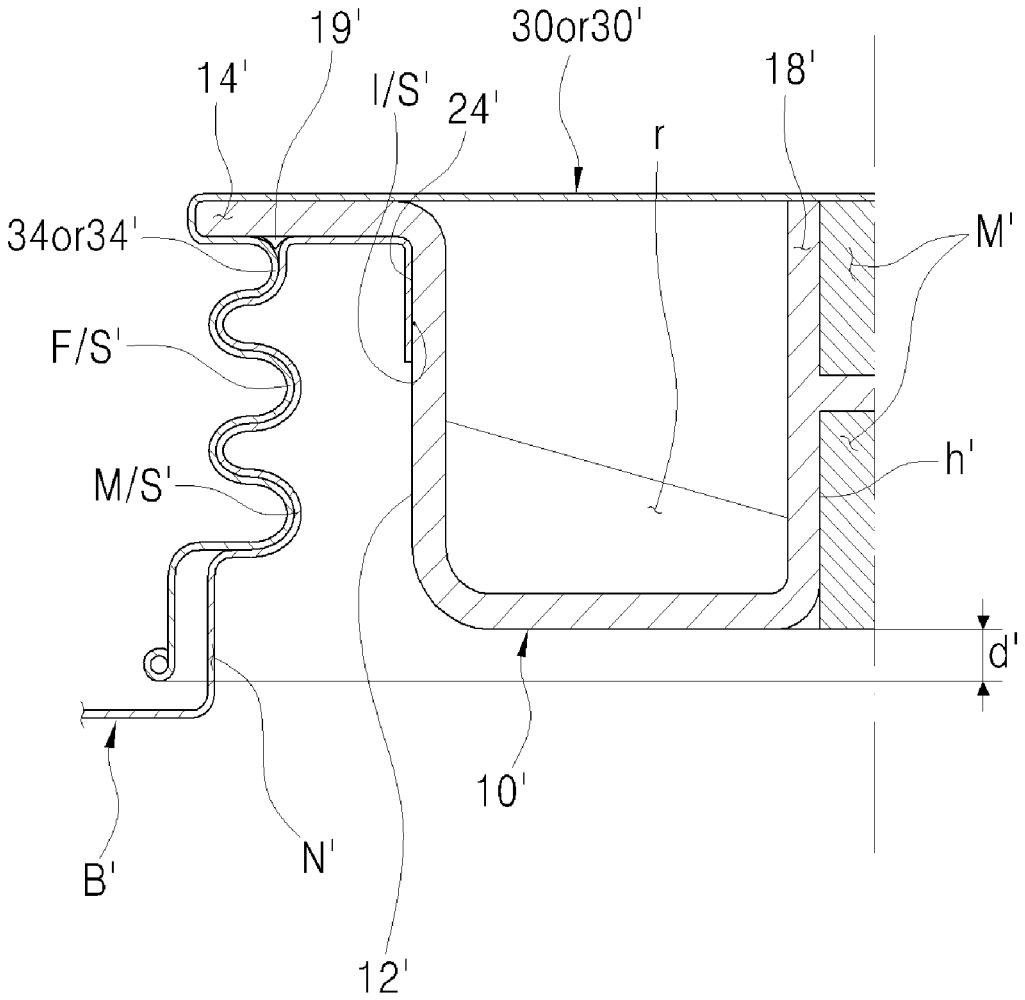

【FIG. 6a】
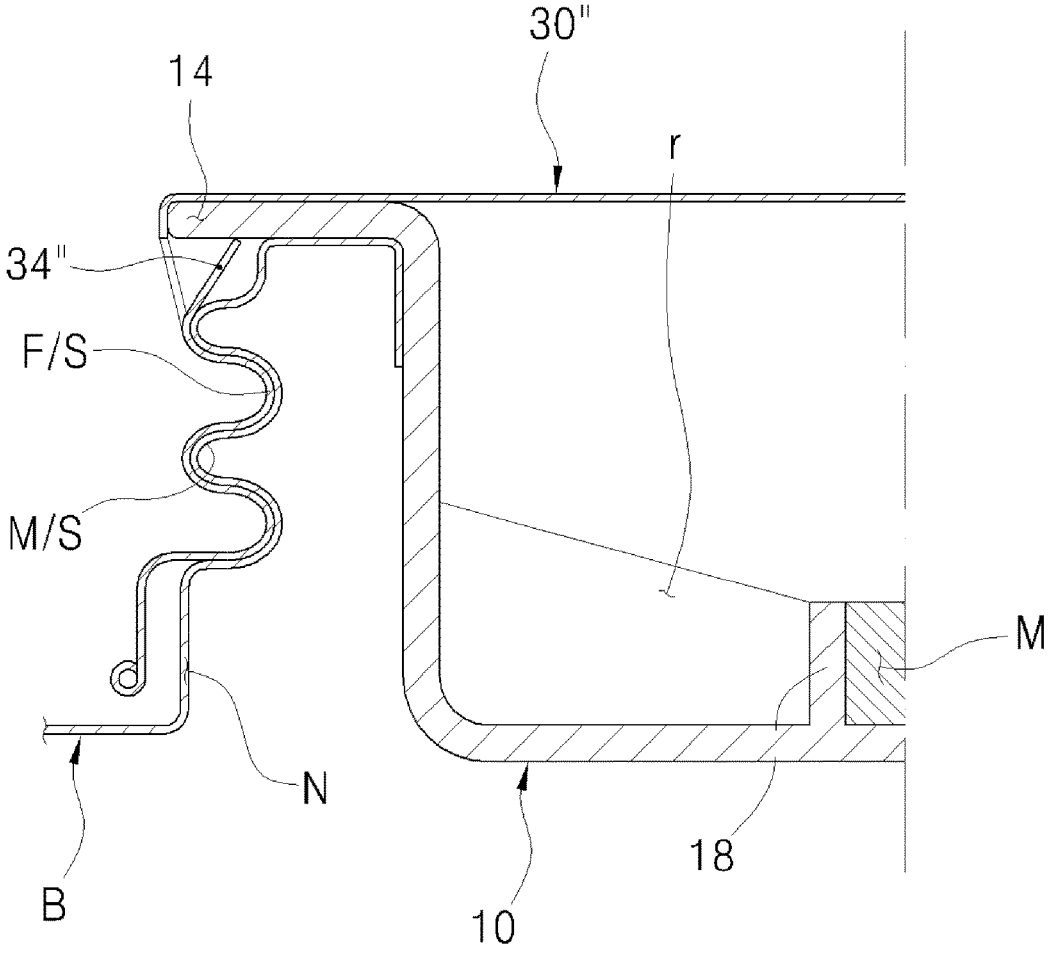

【FIG. 6b】
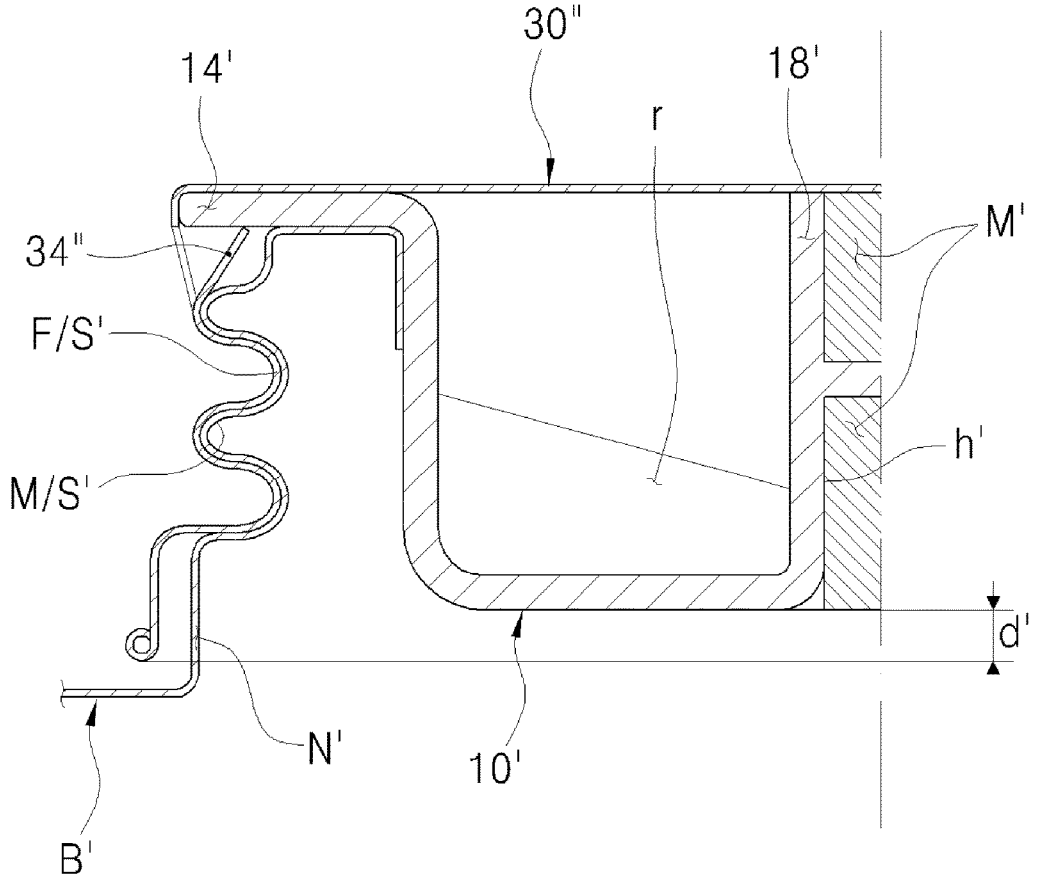

【FIG. 7a】
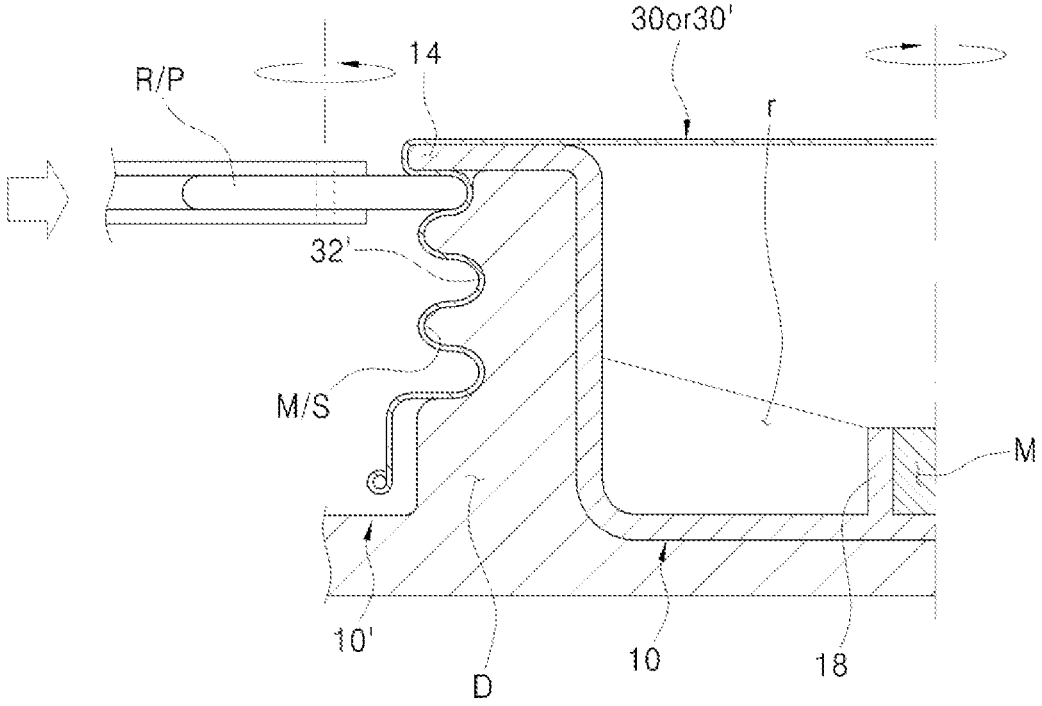

【FIG. 7b】
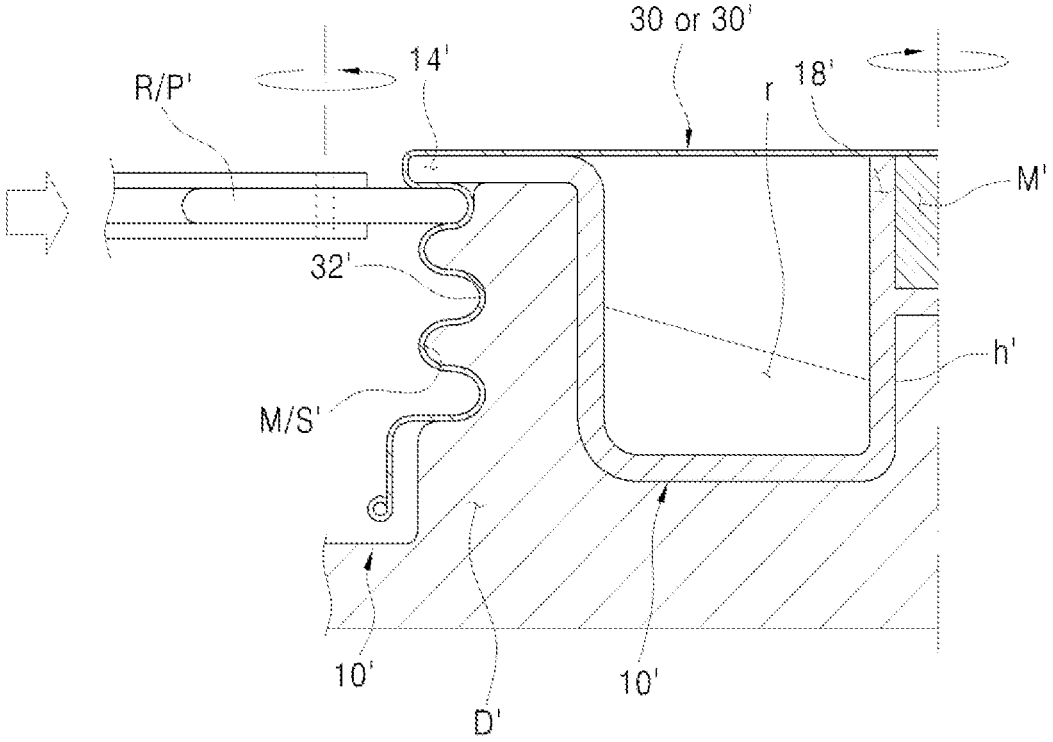

ASSEMBLED CONTAINER CAP

TECHNICAL FIELD

The present invention relates to a container cap assembly that includes an inner cap closely coupled to an inner surface and an upper end of a container neck and an outer cap configured to stably maintain the coupled state of the inner cap, thereby keeping the inside of a container sealed.

BACKGROUND ART

Generally, containers, which contain food and beverages such as mineral water and liquid materials such as oil, paint, chemicals, and the like, have a neck to allow a liquid material to enter and exit therethrough.

In addition, a container is provided, at a neck thereof, with a cap for opening or closing an opening of the neck to limit the inflow or outflow of a liquid material.

In particular, containers for storing highly volatile materials are made of iron having high durability.

In addition, a container cap to close a neck formed at an iron container includes: an inner cap closely coupled to an inner surface and an upper end of the neck and formed of a chemically resistant and soft synthetic resin material to secure sealing of the neck; and an outer cap formed of a rigid material to maintain a coupled state of the inner cap to the neck of a container.

The above-described inner cap is configured to be forcibly inserted into the inner surface of the container neck so that an outer diameter thereof is decreased, thereby being closely coupled thereto by elastic restoration force.

In addition, the inner cap is provided, at an upper end portion thereof, with a flange portion protruding outward so as to correspond to an upper end surface of the neck, and the flange portion is pressed by coupling of the outer cap to the neck to maintain the coupled state of the inner cap to the neck and also to complement the maintenance of sealing together with a lateral portion of the inner cap.

Meanwhile, the outer cap is configured to cover an upper portion of the neck and surround an outer side surface thereof around the upper portion, and is provided, at an inner circumferential surface thereof, with female threads to correspond to male threads of the container neck.

Opening the container cap having the above-described structure from the container neck is performed by the following two-step process. First, the outer cap is separated from the container neck by loosening threads. Subsequently, the portion of the inner cap, inserted into the neck, is separated therefrom by pulling the flange portion of the inner cap.

As such, the two-step container cap separation process is inconvenient, and has difficulty in separating the inner cap from the container neck and handling the contents of a container, with which the inner cap has been smeared (cases in which a toxic material, paint, or the like is smeared on a hand of a user or damages other parts thereof, and the like).

A conventional container cap includes an inner cap and an outer cap that are separately installed, and thus there is a possibility of loss of the inner cap or the outer cap.

To address these problems, Korean Patent Application Registration No. 10-0567206 (hereinafter referred to as 'prior art 1') and Korean Patent Application Registration No. 10-0671720 (hereinafter referred to as 'prior art 2') are disclosed by the present applicant.

Prior arts 1 and 2 have problems in terms of a great number of elements constituting a container cap, and a large number of operations according to coupling due to complicated coupling structures, which is not economical.

In addition, according to prior arts 1 and 2, an outer cap and an inner cap are connected to each other with an interval therebetween, and thus separation of the inner cap is performed after separation of the outer cap (step-wise processes). Moreover, the inner cap is elastically separated continuously after separation of the outer cap and, as a result, a material smeared on the inner cap may be spattered over the surroundings.

In addition, when storing the outer cap and the inner cap, a material smeared on a surface of the inner cap, contacting the material included in a container is smeared on the surroundings.

DISCLOSURE

Technical Problem

Therefore, the present invention has been made in view of the above problems, and it is one object of the present invention to provide a container cap assembly that has a simple structure for coupling between an outer cap and an inner cap that constitute a container cap, maintains the coupled state and thus coupling or decoupling of the container cap assembly to or from a container is performed by a single operation, facilitates storage of the container cap, and prevents the possibility of contamination such as smearing of a material smeared on the inner cap over the surroundings, or the like.

The above and other objects can be accomplished by the present invention described below.

Technical Solution

In accordance with one aspect of the present invention, provided is a container cap assembly including: an inner cap including an outer wall portion closely corresponding to an inner surface of a neck of a container and a flange portion extending outward from an upper end of the outer wall portion to closely correspond to an upper end of the neck; and an outer cap covering an upper portion of the inner cap and an outer circumferential surface of the neck and provided, at an inner circumferential surface of a side wall thereof, with female threads corresponding to male threads formed at the outer circumferential surface of the neck, wherein the inner cap is configured such that an outer edge portion of the flange portion extends from the outer wall portion by equal to or greater than a sum of a thickness of the neck and a height of the male threads, the outer cap is provided, at an upper portion of an inner circumferential surface thereof, a protrusion away from a lower surface of the ceiling by a distance corresponding to the thickness of the flange portion and protruding along a circumference thereof to a position proximate to the outer circumferential surface of the neck, and the inner cap and the outer cap are coupled to each other such that the outer edge portion of the flange portion is inserted between a ceiling surface of the outer cap and the protrusion The outer cap may be formed of a synthetic resin material, the protrusion may be integrally formed annularly along the inner circumferential surface of the outer cap, and the inner cap and the outer cap may be coupled by elastic restoration force of the inner cap such that the flange portion is forcibly inserted between the ceiling of the outer cap and an upper surface of the protrusion.

In addition, the outer cap may be formed of a metal plate material, and the protrusion may be inwardly pressed along an outer circumferential surface of the outer cap.

In this regard, the protrusion may be configured in plural such that the protrusions are arranged along the outer circumferential surface of the outer cap with intervals therebetween. In this regard, an upper side of the protrusions is cut to pass through outer and inner sides of the outer cap so as to support a lower surface of the flange portion, and at least a lower side of opposite and lower sides of the protrusions has a continuously bent shape according to partial pressing of a side wall of the outer cap.

The inner cap may include a support plate extending from a lower end portion of the outer wall portion and having a plate shape, wherein a lower surface of the support plate by the outer wall portion is positioned farther, based on the ceiling surface of the outer cap, than a position of a lower end of the side wall portion of the outer cap, and a magnet may be installed in the support plate.

In this regard, the support plate may be provided with a boss at an upper portion thereof, and the magnet may be forcibly inserted into the boss.

The flange portion may be further provided, at a lower surface thereof, with an annular insertion projection formed along a circumference of the flange portion and inserted into an edge portion of an upper end of the neck and an end portion of an inner side of the protrusion.

Advantageous Effects

As is apparent from the foregoing description, a flange portion of an inner cap protrudes outside of a neck, and an inner surface of an outer cap, corresponding thereto, has an engaging configuration to correspond to an edge of a lower surface of the flange portion and, accordingly, a coupled state of the inner cap and the outer cap is maintained and thus coupling or uncoupling thereof to or from a container may be performed by a single operation, whereby structures according to the design of each element are simple, manufacturing costs are low, and coupling of each configuration is easy.

In addition, an outer cap or an inner cap may be fixed to a surface of a container made of iron by magnetism according to the type of the material contained in a container, and thus ambient contamination is prevented, storage is easy, and use thereof is convenient.

DESCRIPTION OF DRAWINGS

The above and other objects, features and other advantages of the present invention will be more clearly understood from the following detailed description taken in conjunction with the accompanying drawings, in which:

FIGS. 1*a* and 1*b* are cross-sectional views schematically illustrating the configuration of a container cap assembly including an outer cap formed of a synthetic resin material, according to an embodiment of the present invention, and for explaining a coupling relationship between these elements;

FIG. 2 is a partial cutaway perspective view schematically illustrating the configuration of a container cap assembly including an outer cap formed by molding of a metal plate material, according to another embodiment of the present invention, and for explaining a coupling relationship between these elements;

FIG. 3 is a schematic partial cutaway perspective view for explaining a modified embodiment of a protrusion of FIG. 2;

FIGS. 4*a* and 4*b* are schematic cross-sectional views for explaining a coupling relationship between a container neck and the container cap assembly of FIG. 2 or 3;

FIG. 5 is a schematic cross-sectional view for explaining elements of another modified embodiment of the container cap assembly of FIG. 2 and a coupling relationship between these elements;

FIGS. 6*a* and 6*b* are schematic cross-sectional views for explaining a process of forming the protrusion of FIG. 2; and FIGS. 7*a* and 7*b* are schematic cress-sectional views for explaining another example of formation of the protrusion of FIG. 2.

BEST MODE

The present invention provides a container cap assembly including: an inner cap including an outer wall portion closely corresponding to an inner surface of a neck of a container and a flange portion extending outward from an upper end of the outer wall portion to closely correspond to an upper end of the neck; and an outer cap configured to cover an upper portion of the inner cap and an outer circumferential surface of the neck and provided, at an inner circumferential surface of a side wall thereof, with female threads to correspond to male threads formed at the outer circumferential surface of the neck. The inner cap is configured such that an outer end portion of the flange portion extends from the outer wall portion by equal to or greater than a sum of the thickness of the neck and the height of the male threads, the outer cap is provided, at a lower side of the inner circumferential surface thereof, separated apart from a ceiling surface of an upper portion of the inner circumferential surface by the thickness of the flange portion, with a protrusion protruding along the circumference thereof to a position proximate to the outer circumferential surface of the neck, and the inner cap and the outer cap are coupled to each other such that an outer edge portion of the flange portion is inserted between the ceiling surface and the protrusion of the outer cap.

[Mode]

In description of the present invention, a container, upon which installation is performed, stands upright, i.e., a neck of the container is positioned on an upper side. The expression "inner side" as used herein refers to a central direction of the neck of the container or a portion in the same direction, and the expression "outer side" based on the center of the neck of the container refers to a direction opposite to the inner side or a portion in the same direction.

In addition, in description of the present invention, a difference between elements of an embodiment and elements of a modified embodiment will be described by adding apostrophes (' and ") after reference numerals in the drawings, and a detailed description of like elements will be provided only once.

Hereinafter, exemplary embodiments of the present invention will be described in detail with reference to the accompanying drawings.

As illustrated in FIGS. 1*a* to 7*b*, a container cap assembly according to the present invention includes an inner cap 10 including: an outer wall portion 12 forcibly inserted into an inner surface (I/S) of a neck (N) of a container B to closely correspond thereto; and a flange portion 14 having an annular edge shape along the circumference of an upper end of the outer wall portion 12 and protruding outward from the outer wall portion 12, wherein a lower surface thereof closely corresponds to an upper end of the neck N.

As illustrated in FIG. 1*a*, the inner cap 10 may include a support plate 16 extending inward along the circumference of a lower end of the outer wall portion 12 to form a single disk shape.

In addition, the support plate 16 supports the outer wall portion 12 to maintain the circumferential shape thereof, and a lower surface of the support plate 16 may have a flat plate shape so that a material inside the container B does not fill an outer surface of the outer wall portion 12.

In addition, the support plate 16 may be provided, at an upper surface thereof, i.e., an upper portion thereof blocked from direct contact with the material inside the container B, with a boss 18 having a stub tube shape and protruding upward to have an opening, and a magnet M may be installed in the boss 18.

In addition, a rib r may be further installed about the boss 18 between an outer side surface of the boss 18 and an inner side surface of the outer wall portion 12 to prevent deformation such as inward bending of the outer wall portion 12, and the like.

Moreover, a position of the lower surface of the support plate 16, i.e., a distance from an upper surface of the inner cap 10 including the flange portion 14 to the lower surface of the support plate 16, may be farther by a distance d than a height from a lower surface of a ceiling of the outer cap 20 to a lower end of a side wall portion 22 when compared to the outer cap 20, which will be described below.

The distance d is formed so that, corresponding to a case in which, with regard to installation of the support plate 16, the boss 18, and the magnet M, the container B is made of a magnetic material including iron or a magnetic structure is present therearound, the support plate 16 of the inner cap 10 together with the outer cap 20 can be closely fixed to a side surface of the container B or a side surface of a magnetic substance of a structure by magnetism of the magnet M, thereby facilitating storage (handling) of the inner cap 10 and the outer cap 20 in the coupled state.

Meanwhile, an inner cap 10' illustrated in FIG. 1*b* is a modified example of the inner cap 10 of FIG. 1*a*. In this regard, a position of a lower surface of a support plate 16', i.e., a distance between an upper surface of the inner cap 10' including a flange portion 14' and the lower surface of the support plate 16', may be smaller by a distance d' than a height from a lower surface of a ceiling 24' of an outer cap 20' to a lower end of a side wall portion 22' when compared to the outer cap 20', which will be described below.

In addition, the inner cap 10' illustrated in FIGS. 1*b* and 5 may be provided with a stub tube-shaped boss 18' protruding from a central portion of an upper surface of the support plate 16' to a central portion of a ceiling surface of the outer cap 20' described below so as to have upper and lower openings, and a magnet M' may be installed at least on an upper side in each of the upper and lower openings of the boss 18'.

When the magnet M' is installed in each of the upper and lower openings of the boss 18', these magnets M' may be installed such that mutual attraction acts therebetween.

The distance d' described above is formed so that, corresponding to a case in which, with regard to installation of the support plate 16', the boss 18' and the magnet M, the container B is made of a magnetic material including iron or a magnetic structure is present therearound, a ceiling portion 24' of the outer cap 20' together with the inner cap 10' described below can be closely fixed to a side surface of the container B or a side surface of a magnetic substance of a structure by magnetism of the magnet M', thereby facilitating storage (handling) of the inner cap 10' and the outer cap 20' in the coupled state.

In particular, through close fixing of the ceiling portion of the outer cap 20' to an ambient magnetic substance and formation of the distance d', when a material inside a container B', such as paint or the like, is smeared on a surface of the inner cap 10', an effect of preventing the material from being smeared on the surroundings may be obtained.

Meanwhile, in each of the embodiments illustrated in FIGS. 1*a* and 1*b*, the flange portion 14 of the inner cap 10 is configured such that, in a state of installing the flange portion 14 to correspond to the neck N of the container B, an outer edge portion of the flange portion 14 protrudes outside more than an outer circumferential surface E/S of the neck N of the container B about the center of the neck N of the container B.

In this regard, the outer edge portion of the flange portion 14 may protrude outside of the outer circumferential surface E/S of the neck N by a distance D greater than the height of male threads M/S formed at the outer circumferential surface E/S of the neck N of the container B, and may closely contact or be positioned close to an inner circumferential surface I/S of the outer cap 20 described below.

Due to such design of the flange portion 14, an outer edge portion of a lower surface of the flange portion 14 is caught by a protrusion 26 of the outer cap 20 so that the outer cap 20 and the inner cap 10 are integrally coupled to each other.

In addition, as illustrated in FIGS. 4*a* and 4*b*, the above-described flange portion 14 may be further provided with one or more insertion projections 19 having different diameters at a central portion of the protrusion length thereof, i.e., at a portion of a lower surface thereof between the upper end of the neck N of the container B and an inner end portion of the protrusion 26 or a portion of a lower surface thereof, corresponding to the upper end of the neck N of the container B.

The annular projections 19 are installed to further secure sealing of the inside of the container B when the container cap is coupled to the container B.

In addition, the container cap assembly according to the present invention includes the outer cap 20 including the ceiling 24 to cover the upper portion of the inner cap 10 and the side wall portion 22 to cover the inner cap 10 to correspond to the outer circumferential surface of the neck N, the ceiling 24 and the side wall portion 22 being integrally formed, wherein the side wall portion 22 is provided, at an inner circumferential surface thereof, with the female threads F/S corresponding to the male threads M/S formed at the outer circumferential surface of the neck N.

In this regard, the present invention is characterized in that the protrusion 26, which protrudes inward, is formed so that the flange portion 14 of the inner cap 10 is inserted into an upper portion of the inner circumferential surface of the outer cap 20.

Such configuration of the present invention will now be described in further detail with reference to the following embodiments wherein the outer cap 20 is made of a synthetic resin material or is formed by molding of a metal plate material.

Embodiment 1

As illustrated in FIGS. 1*a* and 1*b*, in a container cap assembly according to an embodiment of the present invention, the outer cap 20 is formed of a synthetic resin material by injection molding.

In the outer cap 20 according to one embodiment, the protrusion 26 extends from an upper portion of the inner circumferential surface of the side wall portion 22, away from the ceiling of the side wall portion 22 by a distance including the thickness of the flange portion 14 and an allowance (an allowance for allowing insertion of the flange portion 14), to a proximate position corresponding to the outer circumferential surface E/S of the neck N of the container B.

The protrusion 26 may be annularly formed along the circumference of the side wall portion 22 of the outer cap 20, or a plurality of protrusions 26 may be arranged with intervals therebetween along the circumference of the side wall portion 22 of the outer cap 20. However, as described below, the protrusion 26 may be annularly formed so that the state of coupling between the outer cap 20 and the inner cap 10 can be stably supported.

The protrusion 26 is formed along the circumference of an inner surface of the side wall portion 22 proximate to the ceiling 24, and this acts as a so-called undercut which is difficult to separate from a mold in an injection molding process for manufacturing the outer cap 20 and, accordingly, it is difficult to form desired position and shape of the protrusion 26.

As a method of forming the protrusion 26 as described above, an insert object (not shown) formed of an inorganic material or the like may be installed at a portion of a mold, corresponding to the ceiling 24 and the protrusion 26 of the outer cap 20 and an inner space of the side wall portion 22 therebetween, and then, after injection molding, the insert object that occupies the space may be separated therefrom.

That is, the flange portion 14 of the inner cap 10 is coupled to the protrusion 26 by forcible insertion via deformation such as bending to correspond to the ceiling 24 and the protrusion 26 of the outer cap 20 and the inner space of the side wall portion 22 therebetween, and the coupled state is formed to prevent separation between the inner cap 10 and the outer cap 20 while opening or closing the neck N of the container B.

Embodiment 2

As illustrated in FIGS. 2 to 4*b*, in a container cap assembly according to another embodiment of the present invention, the outer cap 30 or 30' is formed by molding of a metal plate material.

First, in the outer cap 30 illustrated in FIG. 2, a portion of the side wall portion 32 of the outer cap 30, corresponding to the protrusion 26 of the one embodiment, may form an annular groove having a greater depth in a direction from an outer side to an inner side as compared to upper and lower side wall portions 32 adjacent to each other.

As illustrated in FIGS. 7*a* and 7*b*, a protrusion 34 may be formed by fixing the outer cap 30 to a die D (a mold jig) in a state of aligning the inner cap 10 with the outer cap 30, and pressing a portion for forming the protrusion 34 with a pressure roller R/P while rotating the outer cap as well as the die D (e.g., spinning in a so-called drawing process, or the like).

That is, the protrusion 34 of the outer cap 30 may be formed in an installed state of the inner cap 10, which indicates that coupling therebetween can be performed.

In this regard, it is obvious that, in a state of not installing the inner cap 10 with respect to the outer cap 30, the protrusion 34 may be formed using the corresponding die (not shown), and then the flange portion 14 of the inner cap 10 may be forcibly inserted between a ceiling 36 of the outer cap 30 and the protrusion 34 by deformation such as bending.

Accordingly, the protrusion 34 has an inwardly concave groove form that is continuously pressed along the circumference of the side wall portion 32 of the outer cap 30, and thus the protrusion 34 annularly protrudes from an inner side of the side wall portion 32 of the outer cap 30.

FIG. 3 is a modified embodiment illustrating that a plurality of protrusions 34' may be arranged at intervals along the circumference of the side wall portion 32 of the outer cap 30.

In this regard, the protrusions 34' may be formed by pressure drawing using a punch (not shown) instead of the above-described pressure roller R/P.

In addition, the protrusion 34 or 34', or a protrusion 34" illustrated in an enlarged view of FIG. 2 or FIG. 6*a* or 6*b* is configured such that a plurality of protrusions is arranged at intervals along the circumference of the side wall portion 32 of the outer cap 30, an upper boundary portion of the protrusions 34, 34', or 34" is cut to pass through outer and inner sides of an outer cap 30", and the remaining portion thereof on at least a lower side of opposite and lower sides in a length direction (a circumferential direction of a side wall portion 32") is pressed from the side wall portion 32 of the outer cap 30 to have a continuously bent shape.

In this regard, the cut upper portion of the protrusions 34, 34', or 34" supports an edge portion of the lower surface of the flange portion 14 of the inner cap inserted between the protrusion and a ceiling 36" of an outer cap 30", whereby the coupled state of the outer cap 30' and the inner cap 10 is maintained.

In this regard, among the above-described protrusions 34, 34', and 34", the protrusions 34' shown in an enlarged view of FIG. 3 may be formed such that, in a state of installing a die or a jig (not shown) for punching on an inner side of the outer cap 30', only an upper side of the outer cap 30' is cut (a forming process), while a lower portion thereof is pressed to have a punch shape (a drawing process).

The invention claimed is:

1. A container cap assembly comprising:

an inner cap comprising an outer wall portion configured to closely correspond to an inner surface of a neck of a container and a flange portion extending outward from an upper end of the outer wall portion, the flange portion being configured to closely correspond to an upper end of the neck; and an outer cap comprising a ceiling to cover an upper portion of the inner cap and a side wall portion configured to cover an outer circumferential surface of the neck, the ceiling and the side wall portion being integrally formed, wherein:

the side wall portion is provided, at an inner circumferential surface thereof, with female threads configured to correspond to male threads formed at the outer circumferential surface of the neck, the inner cap is configured such that an outer edge portion of the flange portion protrudes from the outer wall portion by equal to or greater than a sum of a thickness of the neck and a height of the male threads, the outer cap is provided, at an upper portion of an inner circumferential surface thereof, a protrusion away from a lower surface of the ceiling by a distance allowing the flange portion to be inserted and protruding along a circumference thereof to a position proximate to the outer circumferential surface of the neck, and the inner cap and the outer cap are coupled to each other such that the outer edge portion of the flange portion is inserted between the lower surface of the ceiling of the outer cap and the protrusion, wherein the inner cap comprises a support plate extending from a lower end portion of the outer wall portion and having a plate shape, a lower surface of the support plate by the outer wall portion is positioned farther, based on a ceiling surface of the outer cap, than a position of a lower end of the side wall portion of the outer cap, and the support plate is provided, at an upper surface thereof, with a boss comprising a magnet therein, and wherein the boss is formed at a position contacting the lower surface of the ceiling of the outer cap and has a rib on an inner side thereof at a half position in a height direction, and the magnet is forcibly inserted into at least an upper side of upper and lower sides of the boss.

2. The container cap assembly of claim 1, wherein:

the outer cap includes a synthetic resin material, the protrusion is integrally formed annularly along the inner circumferential surface of the outer cap, and the inner cap and the outer cap are coupled by an elastic restoration force of the inner cap such that the flange portion is forcibly inserted between the lower surface of the ceiling of the outer cap and an upper surface of the protrusion.

3. The container cap assembly of claim 2, wherein the flange portion is further provided, at a lower surface thereof, with an annular insertion projection pressed on an upper surface of the neck or inserted between an end portion of an inner side of the protrusion and an outer edge of the upper surface of the neck at least one portion of the upper surface and an edge portion of an upper end of the neck along a circumference of the flange portion.

4. The container cap assembly of claim 1, wherein:

the outer cap comprises a metal plate material, and the protrusion is inwardly pressed along an outer circumferential surface of the outer cap.

5. The container cap assembly of claim 4, wherein the protrusion is configured in plural such that the protrusions are arranged along the outer circumferential surface of the outer cap with intervals therebetween.

6. The container cap assembly of claim 5, wherein:

an upper side of the protrusions is pressed from an outer side to an inner side of the outer cap to be cut so as to support an edge portion of a lower surface of the flange portion, and at least a lower side of opposite and lower sides of the protrusions has a bent shape according to partial pressing of a side wall of the outer cap.

7. The container cap assembly of claim 6, wherein the flange portion is further provided, at a lower surface thereof, with an annular insertion projection pressed on an upper surface of the neck or inserted between an end portion of an inner side of the protrusion and an outer edge of the upper surface of the neck at least one portion of the upper surface and an edge portion of an upper end of the neck along a circumference of the flange portion.

8. The container cap assembly of claim 5, wherein the flange portion is further provided, at a lower surface thereof, with an annular insertion projection pressed on an upper surface of the neck or inserted between an end portion of an inner side of the protrusion and an outer edge of the upper surface of the neck at least one portion of the upper surface and an edge portion of an upper end of the neck along a circumference of the flange portion.

9. The container cap assembly of claim 4, wherein the flange portion is further provided, at a lower surface thereof, with an annular insertion projection pressed on an upper surface of the neck or inserted between an end portion of an inner side of the protrusion and an outer edge of the upper surface of the neck at least one portion of the upper surface and an edge portion of an upper end of the neck along a circumference of the flange portion.

10. The container cap assembly of claim 1, wherein the flange portion is further provided, at a lower surface thereof, with an annular insertion projection pressed on an upper surface of the neck or inserted between an end portion of an inner side of the protrusion and an outer edge of the upper surface of the neck at least one portion of the upper surface and an edge portion of an upper end of the neck along a circumference of the flange portion.

* * * * *